US007010240B2

(12) United States Patent
Fuma et al.

(10) Patent No.: US 7,010,240 B2
(45) Date of Patent: Mar. 7, 2006

(54) IMAGE FORMING APPARATUS THAT CONTROLS A FIXING DEVICE TO FIX A TONER IMAGE ONTO PAPER WITH IMPROVED PRODUCTIVITY

(75) Inventors: Hiroshi Fuma, Hachioji (JP); Hisayoshi Nagase, Hachioji (JP); Masahiro Onodera, Hachioji (JP)

(73) Assignee: Konica Corporation, Tokyo (JP)

( * ) Notice: Subject to any disclaimer, the term of this patent is extended or adjusted under 35 U.S.C. 154(b) by 12 days.

(21) Appl. No.: 10/647,635

(22) Filed: Aug. 25, 2003

(65) Prior Publication Data

US 2004/0042809 A1 Mar. 4, 2004

(30) Foreign Application Priority Data

Aug. 29, 2002 (JP) ..... 2002-250504

(51) Int. Cl.
*G03G 15/20* (2006.01)

(52) U.S. Cl. ..... 399/67; 399/328

(58) Field of Classification Search ..... 399/38, 399/67, 69, 42, 45, 68, 328; 219/216
See application file for complete search history.

(56) References Cited

U.S. PATENT DOCUMENTS

| | | | | |
|---|---|---|---|---|
| 5,831,744 | A * | 11/1998 | Kataoka | 358/296 |
| 6,522,843 | B1 * | 2/2003 | Yamada et al. | 399/66 |
| 6,611,670 | B1 * | 8/2003 | Chen et al. | 399/328 |
| 6,721,532 | B1 * | 4/2004 | Kosugi et al. | 399/341 |
| 2002/0085082 | A1 * | 7/2002 | Takeuchi et al. | 347/129 |
| 2003/0099007 | A1 * | 5/2003 | Towner et al. | 358/520 |
| 2005/0007416 | A1 * | 1/2005 | Takekoshi et al. | 347/41 |

* cited by examiner

*Primary Examiner*—Hoan Tran
(74) *Attorney, Agent, or Firm*—Cohen, Pontani, Lieberman & Pavane

(57) ABSTRACT

This invention relates to an image forming apparatus having a fixing device which pressurizes and heats an unfixed toner image on a paper sheet as the transfer medium to fix the image on the paper sheet as the transfer medium. This image forming apparatus includes a glossiness changing device and/or a fixing condition changing device which changes fixing conditions in accordance with the thickness or thickness information of a paper sheet as the transfer medium, and a control section for changing the output order of fixed images to be printed out. This makes it possible to rearrange a printing order so as to shorten the time required to switch a glossiness or change a fixing condition, thereby greatly improving printing efficiency.

11 Claims, 7 Drawing Sheets

FIG.7

St1

| GLOSSINESSES | NUMBER OF PRINTS | INPUT ORDER |
|---|---|---|
| 30° | 10 | (1) |
| 60° | 20 | (2) |
| 30° | 10 | (3) |

St2 CALCULATE FIXED IMAGE OUTPUT ORDER

St3 DETERMINE FIXED IMAGE OUTPUT ORDER ((2)→(1)→(3))

St4 SET FIXING CONDITION (2)

St5 OUTPUT FIXED IMAGE (2)

St6 SET FIXING CONDITION (1)

St7 OUTPUT FIXED IMAGE (1)

St8 SET FIXING CONDITION (3)

St9 OUTPUT FIXED IMAGE (3)

IMAGE FORMING APPARATUS THAT CONTROLS A FIXING DEVICE TO FIX A TONER IMAGE ONTO PAPER WITH IMPROVED PRODUCTIVITY

BACKGROUND OF THE INVENTION

1. Field of the Invention

The present invention relates to an image forming apparatus which can perform control to quickly and efficiently change a fixing condition based on the glossiness of image or the thickness of paper sheet as the transfer medium to be used.

2. Description of the Prior Art

As disclosed in Japanese Unexamined Patent Publication No. 10-307496, a belt type fixing device mounted in an image forming apparatus has a fixing belt endlessly wound around a heating roller, which serves as a heating member incorporating a heater or the like as a heat source, and a support roller placed parallel to the heating roller. The heating roller is pressed against the support roller through the fixing belt and a paper sheet as the transfer medium. The latent image formed on a photosensitive body is developed into a toner image by a developing unit. The toner image is transferred onto the paper sheet as the transfer medium and fixed thereon by the fixing device. The paper sheet as the transfer medium is then discharged outside the apparatus.

It often happens that output commands each having a different glossiness are alternately input. In such a case, it takes time to change fixing conditions so as to change glossiness, resulting in a considerable deterioration in productivity. In addition, when paper sheets each having a different fixing property due to a different thickness or the like are to be used, it takes time to change fixing conditions. This also leads to a deterioration in productivity.

SUMMARY OF THE INVENTION

It is an object of the present invention to solve the above problems in the prior art and provide an image forming apparatus which can improve printing efficiency by minimizing the time required to change a fixing condition even when output commands each having a different glossiness are alternately input or even when transfer media which differ in their fixing properties due to variations in thickness or the like are to be used.

In order to achieve the above object, according to the first aspect of the present invention, there is provided an image forming apparatus having a fixing device which pressurizes and heats an unfixed toner image on a paper sheet as the transfer medium to fix the image on the paper sheet as the transfer medium, comprising glossiness changing means, and control means for changing an output order of fixed images to be printed out.

In order to achieve the above object, according to the second aspect of the present invention, there is provided an image forming apparatus having a fixing device which pressurizes and heats an unfixed toner image on a paper sheet as the transfer medium to fix the image on the paper sheet as the transfer medium, comprising detection means for detecting a thickness of a paper sheet as the transfer medium or thickness information input means for inputting thickness information of the paper sheet as the transfer medium, fixing condition changing means for changing a fixing condition in accordance with the detected thickness or the input thickness information, and control means for changing an output order of fixed images to be printed out.

In order to achieve the above object, according to the third aspect of the present invention, there is provided an image forming apparatus having a fixing device which pressurizes and heats an unfixed toner image on a paper sheet as the transfer medium to fix the image on the paper sheet as the transfer medium, comprising glossiness changing means, detection means for detecting a thickness of a paper sheet as the transfer medium or thickness information input means for inputting thickness information of the paper sheet as the transfer medium, fixing condition changing means for changing a fixing condition in accordance with the detected thickness or the input thickness information, and control means for changing an output order of fixed images to be printed out.

In the image forming apparatus according to the first to third aspects, the glossiness changing means includes at least fixing member temperature changing means.

In the image forming apparatus according to the first aspect, the control means changes a fixed image output order on the basis of glossinesses of series of fixed images to be printed out and the numbers of series of fixed images to be printed out.

In the image forming apparatus according to the second aspect, the control means changes the fixed image output order on the basis of the thickness of the paper sheet as the transfer medium and the numbers of series of images to be printed out.

In the image forming apparatus according to the third aspect, the control means changes the fixed image output order on the basis of glossinesses of series of fixed images to be printed out and the numbers of series of images to be printed out.

As is obvious from the respective aspects, according to the present invention, printing efficiency can be greatly improved by changing the printing order so as to minimize the time required to switch glossinesses or change fixing conditions even when output commands each having a different glossiness are input in an arbitrary order or commands to use transfer media which differ in their fixing conditions due to variations in thickness or the like are input in an arbitrary order.

Assume that the ordinal rank of prints in the output order is preferably increased in terms of saving the time for glossiness switching. Even in this case, if the number of prints is extremely large, a program can be designed not to forcibly increase the ordinal rank in the output order so as to prevent excessive prolongation of wait times for prints in the remaining ordinal ranks.

BRIEF DESCRIPTION OF THE DRAWINGS

FIG. 7 is a flow chart showing an example of the process of changing the print output order in the image forming apparatus according to the present invention.

DETAILED DESCRIPTION OF THE PREFERRED EMBODIMENT

A preferred embodiment of the present invention will be described below with reference to the accompanying drawings. Note that the following description will not limit the technical scope of claims or the meanings of terms. Note also that the assertive description in the embodiments of the present invention will exemplify the best mode but will not limit the meanings of terms and the technical scope of the present invention.

Figure 1:
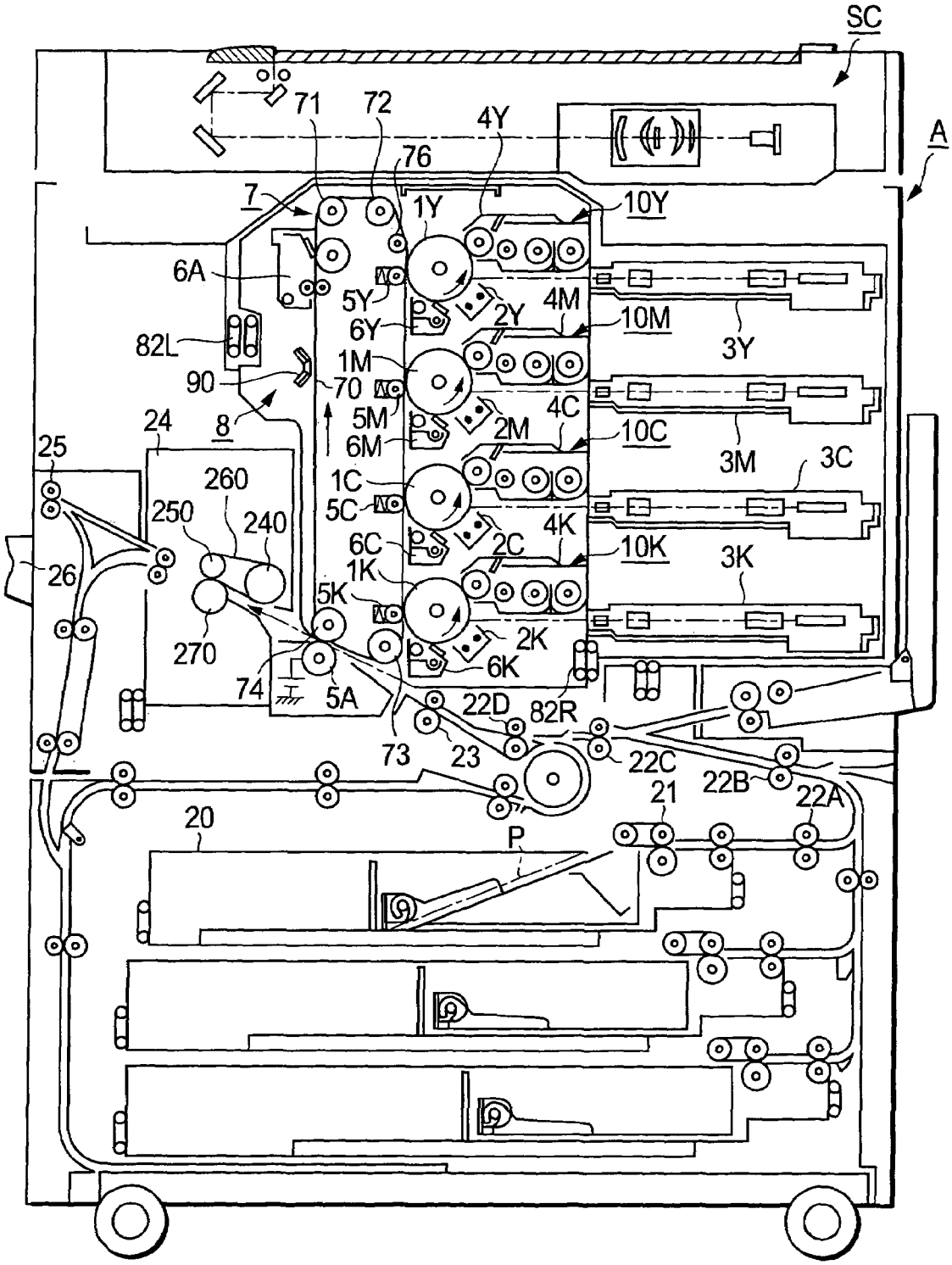
FIG. 1 is a sectional view showing the arrangement of a color image forming apparatus according to an embodiment of the present invention.

FIG. 1 shows a color image forming apparatus according to an embodiment of the present invention. This color image forming apparatus is a so-called tandem type color image forming apparatus and comprised of a plurality of image forming sections 10Y, 10M, 10C, and 10K, an endless belt type intermediate transfer unit 7, a paper feed section 21, and a belt type fixing device 24 serving as a fixing device. An original image reader SC is placed on a main body A of the image forming apparatus.

The image forming section 10Y for forming yellow images includes a drum-like photosensitive body 1Y serving as the first image carrier, and the following components arranged around the photosensitive body 1Y: a charger 2Y, an exposure device 3Y, a developing unit 4Y, a primary transfer roller 5Y serving as a primary transfer means, and a cleaning device 6Y.

The image forming section 10M for forming magenta images includes a drum-like photosensitive body 1M serving as the first image carrier, and the following components arranged around the photosensitive body 1M: a charger 2M, an exposure device 3M, a developing unit 4M, a primary transfer roller 5M serving as a primary transfer means, and a cleaning device 6M.

The image forming section 10C for forming cyan images includes a drum-like photosensitive body 1C serving as the first image carrier, and the following components arranged around the photosensitive body 1C: a charger 2C, an exposure device 3C, a developing unit 4C, a primary transfer roller 5C serving as a primary transfer means, and a cleaning device 6C.

The image forming section 10K for forming black images includes a drum-like photosensitive body 1K serving as the first image carrier, and the following components arranged around the photosensitive body 1K: a charger 2K, an exposure device 3K, a developing unit 4K, a primary transfer roller 5K serving as a primary transfer means, and a cleaning device 6K.

The endless belt type intermediate transfer unit 7 has an endless belt type intermediate transfer member 70 in the form of a semiconductive endless belt serving as the second image carrier, which is wound around a plurality of rollers so as to be pivotally held.

The images of the respective colors formed by the image forming sections 10Y, 10M, 10C, and 10K are sequentially transferred onto the pivoting endless belt type intermediate transfer member 70 by the primary transfer rollers 5Y, 5M, 5C, and 5K to form a composite color image.

A paper sheet as the transfer medium P as a recording medium stored in a paper feed cassette 20 is fed by a paper feed section 21 and conveyed to the secondary transfer roller 5A through a plurality of intermediate rollers 22A, 22B, 22C, and 22D and registration rollers 23. The color image is then transferred onto the paper sheet as the transfer medium P at once by the secondary transfer section 5A. The paper sheet as the transfer medium P on which the color image is transferred is subjected to fixing processing by the belt type fixing device 24. The paper sheet as the transfer medium P is then clamped by paper discharge rollers 25 and placed on a paper discharge tray 26 located outside the apparatus.

After the color image is transferred onto the paper sheet as the transfer medium P by the secondary transfer roller 5A serving as a secondary transfer means, the cleaning device 6A removes the residual toner from the endless belt type intermediate transfer member 70 from which the paper sheet as the transfer medium P is curvature-separated.

During an image forming process, the primary transfer roller 5K is always in tight contact with the photosensitive body 1K. The remaining primary transfer rollers 5Y, 5M, and 5C are brought into tight contact with the corresponding photosensitive bodies 1Y, 1M, and 1C only at the time of color image formation.

The secondary transfer roller 5A is brought into tight contact with the endless belt type intermediate transfer member 70 only when the paper sheet as the transfer medium P passes therethrough and secondary transfer is performed.

Figure 2:
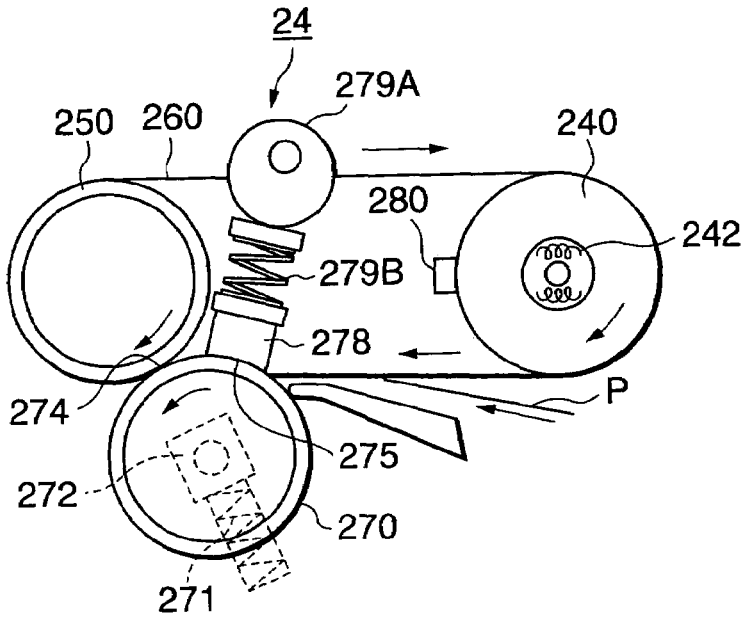
FIG. 2 is a sectional view showing the arrangement of a belt type fixing device mounted in the image forming apparatus according to the present invention in a state wherein a pad is activated.

The belt type fixing device 24 mounted in the image forming apparatus according to the present invention will be described in detail next with reference to the sectional view of FIG. 2.

The belt type fixing device 24 is basically comprised of a heating roller 240 having a heating portion 242 formed from a heat source such as a halogen lamp, a support roller 250 placed to be parallel to the heating roller 240 and spaced apart therefrom, a fixing belt 260 endlessly wound around the heating roller 240 and support roller 250, and a pressure roller 270 which forms a main nip portion 274 between itself and the fixing belt 260 by pressing the support roller 250 with a spring 271 serving as a pressing means through the fixing belt 260, and also forms, on the upstream side, an auxiliary nip portion 275 between itself and the fixing belt 260 by using a pad 278 biased by a spring 279B and a cam 279A which adjusts the compressive force of the spring. A temperature sensor 280 is placed on or near the surface of the heating roller 240. A bearing portion 272 which axially supports the pressure roller 270 is pressed by the spring 271 serving as a pressing means.

The fixing belt 260 is formed into an endless belt by laminating a metal substrate or a high-temperature resin substrate and silicone rubber into a belt form. In order to improve the mold releasability, a mold releasing layer made of PFA or PTFE may be formed on the surface of the belt.

Figure 4:
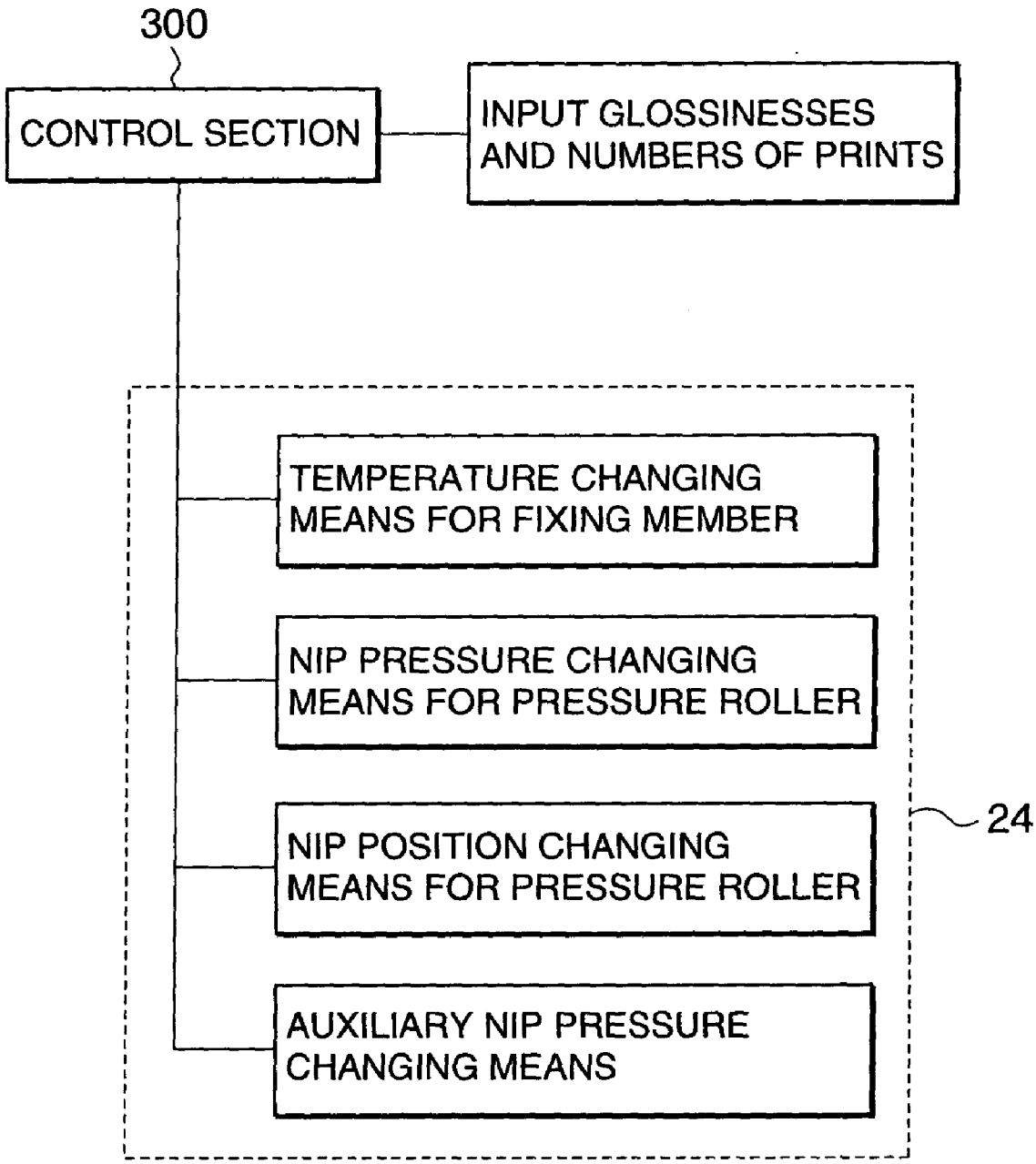
FIGS. 4, 5, and 6 are block diagrams showing three control examples of changing the print output order in the image forming apparatus according to the present invention.

As shown in the block diagram of FIG. 4, when image formation commands each having a different glossiness are input, control is so performed as to output fixed images upon making commands with the same glossiness or commands exhibiting relatively small glossiness differences temporally adjacent to each other, thereby increasing the overall productivity.

Figure 5:
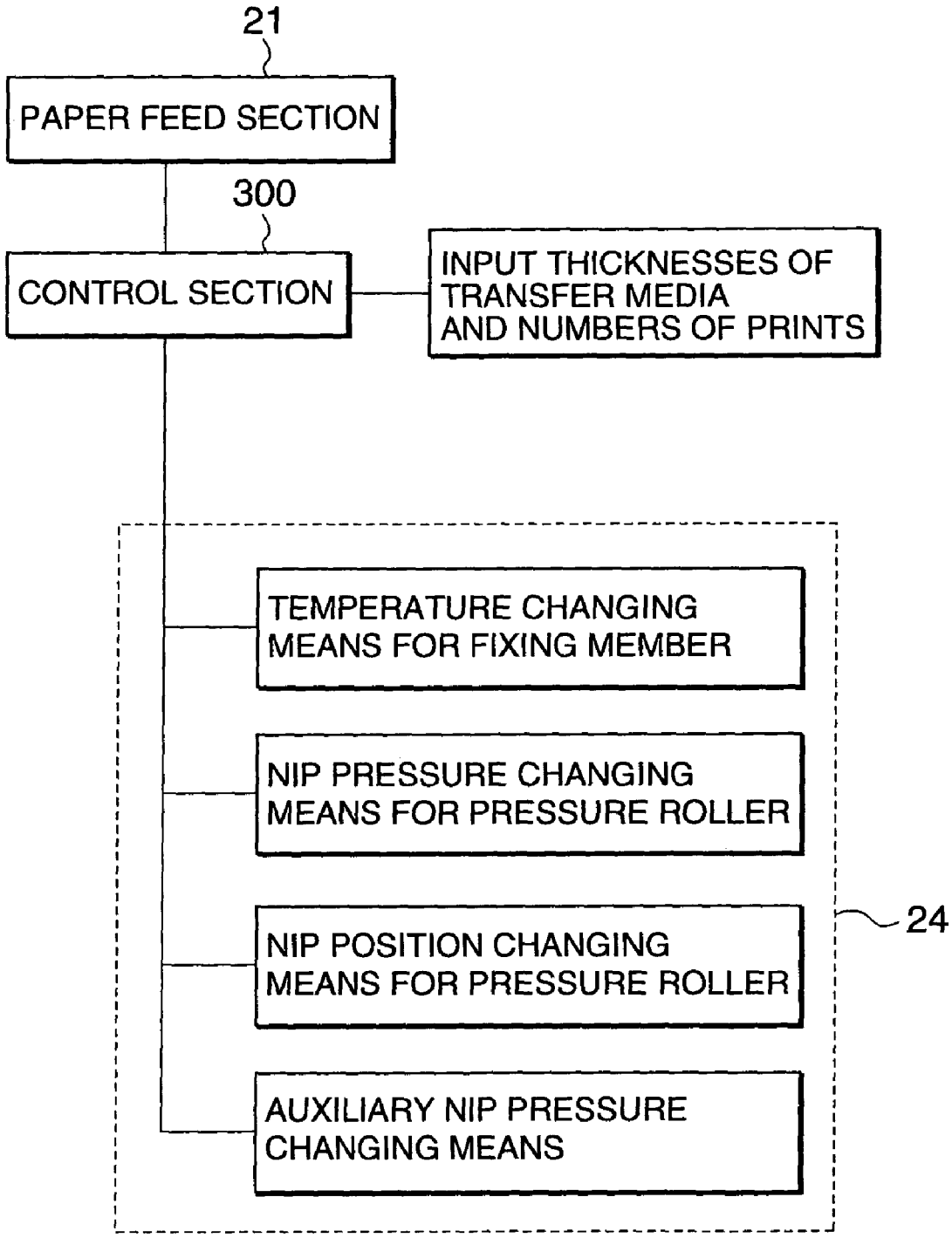

In addition, as shown in the block diagram of FIG. 5, when fixing processing is to be performed for paper sheets exhibiting different fixing properties due to variations in thickness or the like, in order to shorten the time required to change the fixing conditions, the fixed image output order is so changed as to reduce the differences between the fixing conditions to be changed. The order of paper sheets fed from the paper feed section 21 is then changed on the basis of the above change.

Figure 6:
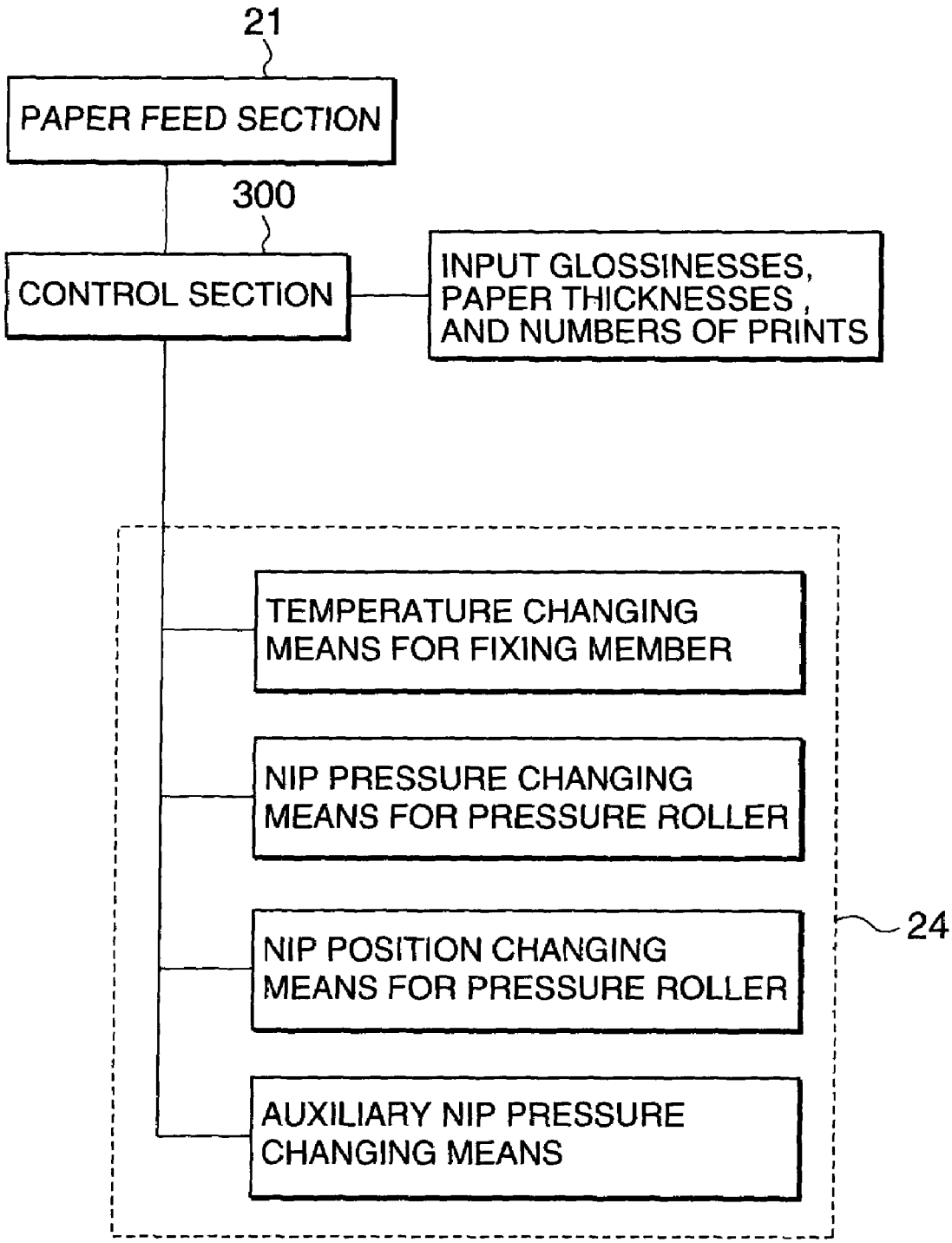

Furthermore, as shown in the block diagram of FIG. 6, when fixing processing is to be performed for paper sheets which differ in both glossiness and thickness, in order to shorten the time required to change the fixing conditions, the fixed image output order is so changed as to reduce the differences between the fixing conditions to be changed. The order of paper sheets fed from the paper feed section 21 is then changed on the basis of the above change. In other words, control can be performed to output fixed images while making changes in both glossiness and paper thickness.

In this manner, after toner images are formed on the photosensitive bodies by charging, exposure, and development and the respective colors are superimposed on the transfer belt, the images are transferred onto the paper sheet as the transfer medium P at once. The transferred images are then pressurized/heated by the belt type fixing device to be fixed on the paper sheet as the transfer medium P. After the toner images are transferred onto the paper sheet as the transfer medium P, the cleaning devices clean the photosensitive bodies by removing the toner left thereon in the transfer process. Thereafter, the above cycle of charging, exposure, and development is started again to repeat the next image formation, thereby printing images on paper sheets with a necessary glossiness, a necessary thickness, and a necessary number of copies.

Figure 3:
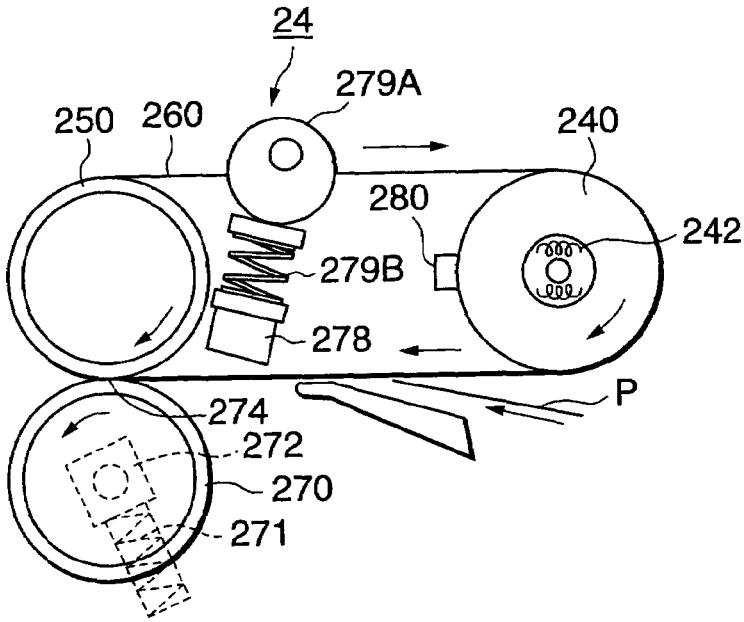
FIG. 3 is a sectional view showing the arrangement of the belt type fixing device mounted in the image forming apparatus according to the present invention in a state wherein the pad is inactivated.

A print with a high glossiness can be obtained by forming the auxiliary nip portion 275 and raising the control temperature of the fixing belt 260. A print with a low glossiness can be obtained by moving the pressure roller 270 so as not to form the auxiliary nip portion 275 as indicted by the sectional view of FIG. 3 and, if necessary, lowering the control temperature of the fixing belt 260. A print with an intermediate glossiness can also be obtained by properly combining the above conditions, i.e., a temperature and presence/absence of the auxiliary nip portion 275.

When a single image formation command is input, a fixed image is output upon selecting the presence/absence of the auxiliary nip portion 275 and a temperature for the fixing belt 260 in accordance with the glossiness designation contained in the command.

When a plurality of image formation commands are input and queued, a control section 300 of the image forming apparatus rearranges the fixed image output order so as to shorten the switching time, regardless of the input order of the plurality of image formation commands, in accordance with the glossiness designations or the like contained in the commands, as indicated by the flow chart of FIG. 7.

As shown in FIG. 7, assume that in an image forming apparatus designed to deliver 60 prints per min and take 60 s and 15 s for switching of 60° (glossiness)→30° and 30°→60°, respectively, while an image formation command for 20 prints with a glossiness of 60° has been input as the (0)th command and fixed image output operation is performed on the basis of this command, image formation commands are input in St1 which include the (1)st command for 10 prints with a glossiness of 30°, the (2)nd command for 20 prints with a glossiness of 60°, and the (3)rd command for 10 prints with a glossiness of 30°. In this case, in St2, the control section 300 calculates the output order of fixed images queued in the above input order. In St3, the control section 300 determines the output order of fixed images and rearranges it into a fixed image output order such that image formation commands are executed in the following order: the (2)nd command (in the input order) for 20 prints with a glossiness of 60°, the (1)st command (in the input order) for 10 prints with a glossiness of 30°, and the (3)rd command (in the input order) for 10 prints with a glossiness of 30°. The control section 300 then sets print fixing conditions corresponding to the (2)nd image formation command in the input order in St4, and outputs prints in St5. The control section 300 sets print fixing conditions corresponding to the (1)st image formation command in the input order in St6, and outputs prints in St7. The control section 300 sets print fixing conditions corresponding to the (3)rd image formation command in the input order in St8, and outputs prints in St9.

If fixed images are output in the input order of image formation commands, fixing condition switching for glossiness must be performed three times like 60°→30°→60°→30°. The rearrangement of the fixed image output order makes it suffice to perform fixing condition switching for glossiness only once like 60°→30°. This can greatly shorten the time required for fixing condition switching from 135 s to 60 s.

This effect is enhanced in a roller fixing device or the like, other than a belt type fixing device, which is a high thermal capacity device that requires much time for glossiness switching and is not allowed to select any auxiliary nip.

If three or more kinds of glossinesses are designated, instead of two kinds of glossinesses, image formation commands may be rearranged in ascending or descending order. Image formation commands may be rearranged upon assignment of weights, instead of being rearranged uniformly, depending on the numbers of prints. (In the above case, if an image formation command for 1,000 prints with a glossiness of 60° is input as the second formation command and a fixed image output order is rearranged in the above manner, a command for a glossiness of 30° which may be input by a different user is forced to wait for an extra time of 17 min.) In such a case, an output order can be impartially rearranged by using a special program.

In general, it takes time to change temperature (in the case of a combination of changes in temperature and auxiliary nip or in the case wherein only temperature is changed), and hence rearrangement is preferably performed to reduce the number of times glossiness is changed by lowering temperature. When paper sheets (their cassettes) are designated and a plurality of output commands are input, fixing conditions must be changed to temperatures and auxiliary nip amounts required for the respective paper sheets as transfer media P. In this case, the output order is preferably changed to improve the overall productivity.

Figure 8:
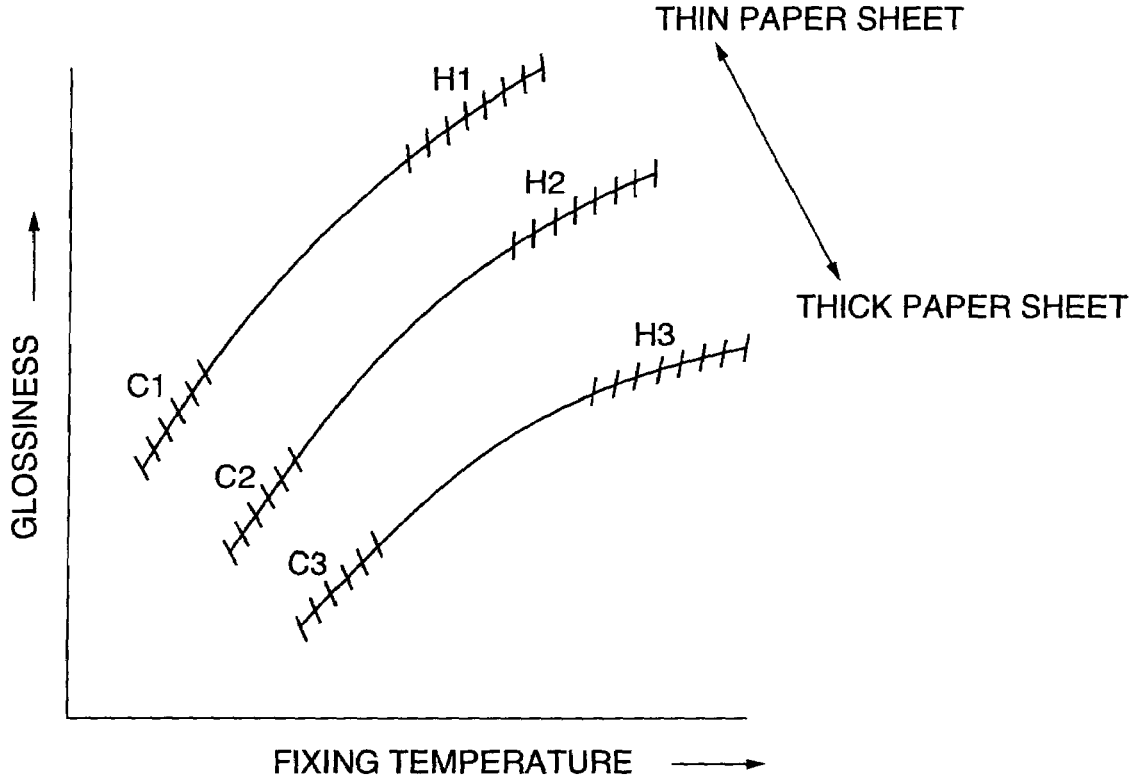
FIG. 8 is a graph showing areas where offsets occur in the relationship between the glossiness and the fixing temperature with respect to the paper thickness.

As shown in the graph of FIG. 8, proper fixing areas vary depending on the thickness of a paper sheet as the paper sheet as the transfer medium P, and conditions for obtaining the same glossiness vary. Reference symbols C1 to C3 denote insufficient fixing areas; and H1 to H3, hot offset areas. This graph also indicates a property that as the thickness of a paper sheet decreases, glossiness increases at the same heating temperature. Although this indicates a temperature dependence, a similar dependence is observed with respect to the presence/absence of an auxiliary nip or pressure. Proper conditions vary depending on the thickness of a paper sheet. Therefore, the temperature setting must be changed depending on the thickness of a paper sheet. When the paper thickness changes like "thick→thin→thick→thin", the output order is preferably changed in accordance with "thick→thick→thin→thin" in terms of improving printing efficiency.

The fixing belt 260 is driven by the support roller 250 or pressure roller 270. A paper sheet as the paper sheet as the transfer medium P having a toner image held thereon, which is conveyed to the fixing area by a paper feed guide and the like, and the fixing belt 260 are clamped and pressured by the pressure roller 270 and support roller 250. The paper sheet as the paper sheet as the transfer medium P is clamped at the auxiliary nip portion 275 between the pressure roller 270 and the fixing belt 260 wound around the pressure roller 270, before being clamped at the main nip portion 274 between the pressure roller 270 and the support roller 250, and is pressured/pre-heated by the pad 278. Thereafter, the image is fixed on the paper sheet as the paper sheet as the transfer medium P with a predetermined high glossiness by the heat held by the fixing belt 260 and the pressure applied by the pressure roller 270. A rubber member is brought into contact with the toner layer directly or through a thin mold releasing layer. The rubber member deforms to conform to the unevenness of the toner layer so as to uniformly contact the toner layer, thereby uniformly fixing the image without any glossiness unevenness or the like. As a consequence, the toner image has a proper glossiness. In addition, after the fixing process, the paper sheet as the paper sheet as the transfer medium P is stably separated from the fixing belt 260.

This embodiment has exemplified the case wherein the belt type fixing device 24 performs glossiness control by combining the auxiliary nip portion 275 and the temperature of the fixing belt 260. Obviously, however, as a fixing device, a roller fixing device may be used in place of a belt type device, and the present invention is effective even for a case wherein the control section 300 performs control by changing fixing pressure, fixing speed, and the like as well as the width of the auxiliary nip portion 275 and the temperatures of the fixing belt 260 and fixing roller or switching fixing pressures, fixing speeds, and the like. The same applies to changing of fixing conditions in accordance with the thickness of a paper sheet.

The use of this arrangement makes it possible for the present invention to obtain high overall productivity in printing.

What is claimed is:

1. An image forming apparatus having a fixing device which pressurizes and heats an unfixed toner image on a paper sheet as the transfer medium to fix the image on the paper sheet, comprising:

a glossiness changing device; and a controller to change an output order of fixed images to be printed out based on glossiness set by said glossiness changing device.

2. The apparatus according to claim 1, wherein said glossiness changing device includes at least a fixing member temperature changing device.

3. An image forming apparatus having a fixing device which pressurizes and heats an unfixed toner image on a paper sheet as the transfer medium to fix the image on the paper sheet, comprising:

a glossiness changing device; and a controller to change a fixed image output order based on glossinesses of series of fixed images to be printed out and numbers of the series of fixed images to be printed out.

4. An image forming apparatus having a fixing device which pressurizes and heats an unfixed toner image on a paper sheet as the transfer medium to fix the image on the paper sheet, comprising:

a detector to detect a thickness of the paper sheet or a thickness information input device to input thickness information of the paper sheet;

a fixing condition changing device to change a fixing condition based on the detected thickness or the input thickness information; and a controller to change an output order of fixed images to be printed out based on the thickness of the paper sheet.

5. The apparatus according to claim 4, wherein said fixing condition changing device includes at least a fixing member temperature changing device.

6. An image forming apparatus having a fixing device which pressurizes and heats an unfixed toner image on a paper sheet as the transfer medium to fix the image on the paper sheet, comprising:

a detector to detect a thickness of the paper sheet or a thickness information input device to input thickness information of the paper sheet;

a fixing condition changing device to change a fixing condition based on the detected thickness or the input thickness information; and a controller to change the fixed image output order based on the thickness of the paper sheet and numbers of series of images to be printed out.

7. The apparatus according to claim 6, wherein said fixing condition changing device includes at least a fixing member temperature changing device.

8. An image forming apparatus having a fixing device which pressurizes and heats an unfixed toner image on a paper sheet as the transfer medium to fix the image on the paper sheet, comprising:

a glossiness changing device;

a detector to detect a thickness of a the paper sheet or a thickness information input device to input thickness information of the paper sheet;

a fixing condition changing device to change a fixing condition based on the detected thickness or the input thickness information; and a controller to change an output order of fixed images to be printed out based on glossiness set by the glossiness changing device, the thickness of the paper sheet, and numbers of series of images to be printed out.

9. The apparatus according to claim 8, wherein said fixing condition changing device includes at least a fixing member temperature changing device.

10. An image forming apparatus having a fixing device which pressurizes and heats an unfixed toner image on a paper sheet as the transfer medium to fix the image on the paper sheet, comprising:

a glossiness changing device;

a detector to detect a thickness of the paper sheet or a thickness information input device to input thickness information of the paper sheet;

a fixing condition changing device to change a fixing condition based on the detected thickness or the input thickness information; and a controller to change the fixed image output order based on glossinesses of series of fixed images to be printed out and numbers of series of images to be printed out.

11. The apparatus according to claim 10, wherein said fixing condition changing device includes at least a fixing member temperature changing device.

* * * * *